United States Patent [19]

Bonner

[11] 4,108,227

[45] Aug. 22, 1978

[54] MAILING BAG WITH ADDRESS CARD MOUNTING POCKET

[75] Inventor: Cletus D. Bonner, Beaver, Pa.

[73] Assignee: Strayer Coin Bag Company, Inc., New Brighton, Pa.

[21] Appl. No.: 865,737

[22] Filed: Dec. 29, 1977

[51] Int. Cl.[2] ..... A45C 13/42

[52] U.S. Cl. ..... 150/15; 40/10 D

[58] Field of Search ..... 150/13, 15, 23; 40/10 D, 159, 359

[56] References Cited

U.S. PATENT DOCUMENTS

| | | | |
|---|---|---|---|
| 3,078,897 | 2/1963 | Rifkin | 150/13 |
| 3,818,963 | 6/1974 | Whitman | 150/15 |

*Primary Examiner*—Donald F. Norton

*Attorney, Agent, or Firm*—W. Britton Moore

[57] ABSTRACT

A panelled mailing bag with zippered opening and a spaced two-part address card mounting pocket on a panel thereof with a card so received therein that the mid portion is exposed to receive postage and enable ready cancellation thereof. The card is apertured for securement by seal means to the zipper slide to retain the card in its pocket and the slide zipper in closed position.

6 Claims, 4 Drawing Figures

MAILING BAG WITH ADDRESS CARD MOUNTING POCKET

This invention relates to a zippered opening mailing bag with a spaced two-part mounting pocket in a panel thereof for receiving an address card therein with the mid portion exposed for receiving postage and enabling ready cancellation thereof.

While it has been customary to utilize zippered mailing or transit bags for depositing funds in financial institutions, and for other purposes, with address or mailing cards variously attached thereto, such as that disclosed in Whitman U.S. Pat. No. 3,818,963 June 25, 1974, these bags are usually plastic or fabric, and the cards are loosely attached to or concealed in the mounting pockets, it is difficult to apply postage thereto and for the Post Office to cancel the same.

The principal object of the present invention is to provide a zippered opening panelled mailing bag with a two-part mounting pocket on a panel thereof, with the two sections centrally spaced apart so that the upper and lower portions of an address card sleeved therein will be covered and the mid section thereof will be exposed to enable the application of postage thereto and its cancellation thereon.

Another object of the provision of a panelled mailing bag with a spaced two-part address card mounting pocket on a panel thereof with a card so sleeved therein that the spaced end portions are covered and the mid portion is exposed to receive postage and enable ready cancellation thereof, and wherein the upper end of the card is apertured for securement by seal means to the zipper slide to retain the card in its pocket and the slide zipper in closed position.

A further object is to provide a two-part address card mailing pocket wherein the upper and lower sections are covered by transparent windows and the mid portion therebetween is exposed so that the end sections may respectively identify the addressor and addressee and postage may be readily applied to the exposed mid portion and cancelled therefrom.

Still another object is the provision of a panelled zippered mailing bag with a two-part card mailing pocket thereon which facilitates attachment of the address card thereto and enables the postal authorities to cancel the postage thereon without repeated handling of the bag and or card.

A still further object is to provide a transit bag which will provide a much needed service for large users of such bags and embodying the aforementioned features at a more competitive price than heretofore has been possible.

These and other objects and advantages will be apparent as the specification is considered with the accompanying drawings, wherein FIG. 1 is a perspective view of a zippered mailing bag embodying this invention;

Figure 1:
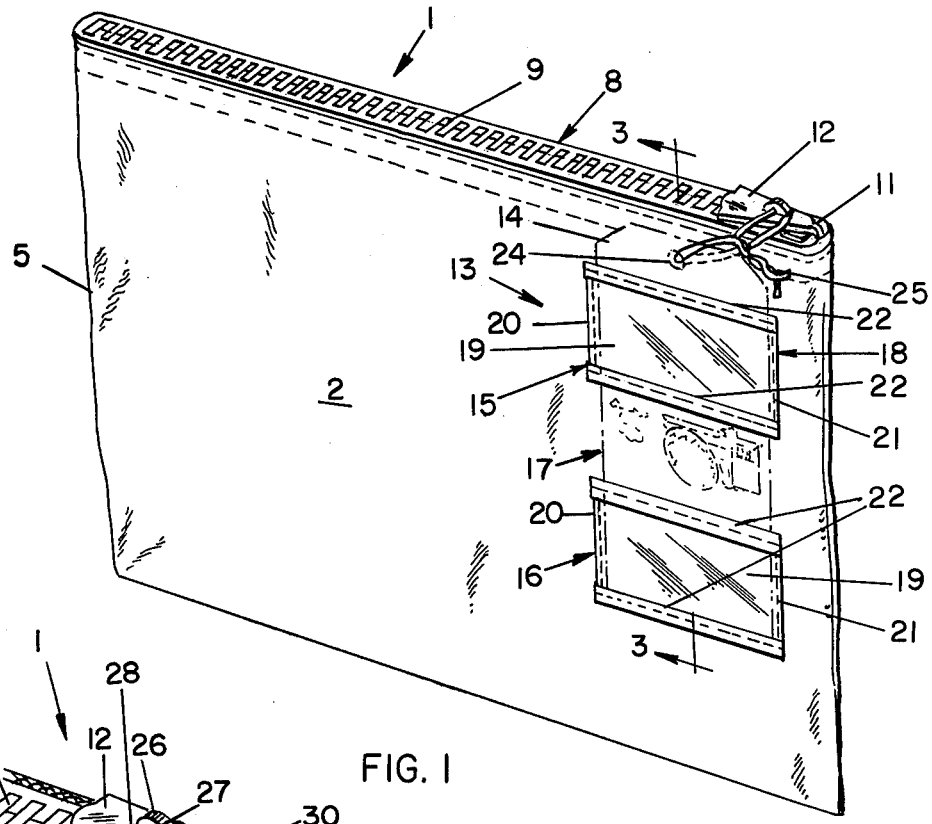

Referring more particularly to the drawings, wherein similar reference characters designate like parts throughout the several views, numeral 1 generally refers to a bag-like container for carrying mail and the like and consisting of two rectangular panels 2 and 3 of some suitable flexible opaque material, such as Nylon or other plastic or woven fabric. These panels are formed from a single sheet of material and are joined together by a fold line along bottom edge 4 and by sewing or stitching 5 along the end edges to form a main pocket 6.

A mouth for the main pocket is formed by the two top edges 7 of the two panels 2–3, and a slide fastener 8 is connected to and extends therealong for selectively opening and closing the mouth. The slide fastener may be of any conventional type usually including a single continuous tooth strip 9 sewn to the panels adjacent top edges, as at 10. A slider 11 having a finger grip 12 pivoted thereto cooperates with the tooth strip to open and close the mouth of the bag as it is drawn back and forth from one end of the bag to the other, in the usual manner.

Arranged adjacent and generally parallel to one end of one of the panels 2–3 is a card pocket 13 for receiving an address and postage card 14. The card pocket is defined by a generally rectangular upper section 15, spaced below and spaced from the zippered bag mouth, and a correspondingly shaped bottom section 16 spaced below the upper section to provide an open and uncovered mid section 17 therebetween. Each section 15–16 is bordered with a suitable edge binding 18 extending therearound, and a transparent flexible viewing patch 19 of some suitable plastic material is affixed to the edge bindings so as to be superposed over the respective pocket sections. The vertically extending side edges 20 of bindings 18 are suitably affixed, by stitching or the like 21, to front panel 2 and with the upper and lower transverse binding edges 22 being unattached to the panel. Thus, the card 14 may be sleeved downwardly through the two spaced sections 15–16 until the lower edge of the card abuts the attached lower binding edge 22 of lower section 16, so that the upper and lowermost portions of the card are covered and protected by the transparent viewing patches 19, and the mid portion 23 of the card is exposed and uncovered. As the addresses of the addressor and addressee are inscribed on the spaced and covered upper and lower portions of the card and are visible therethrough, postage may be readily affixed to the uncovered midportion 23, and may be cancelled with ease by the postal authorities.

Figure 2:
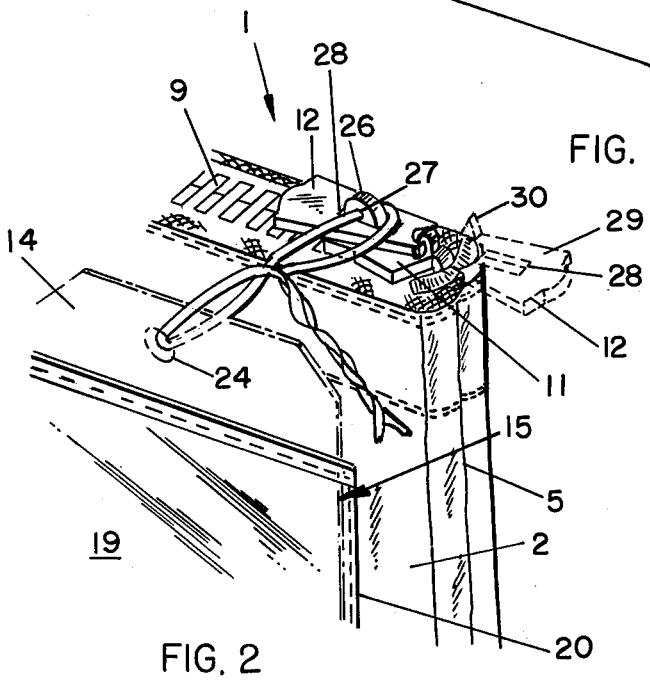
FIG. 2 is a perspective view of an upper corner portion of the bag, showing the upper apertured end of the address card arranged in the mounting pocket and secured by a plastic seal to the zipper slide.
Figure 3:
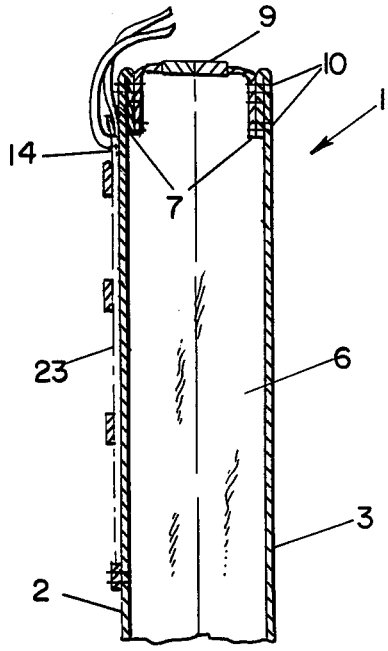
FIG. 3 is a section on the line 3—3 of FIG, 1.
Figure 4:
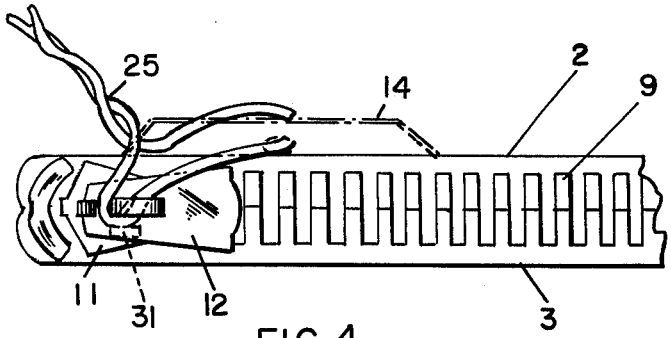
FIG. 4 is a top view of one end of the zippered bag showing the plastic seal interconnection between the address card and zipper slide.

When the card is arranged within pocket 13, the upper end thereof projects upwardly beyond the uppermost transverse edge binding 22 of the upper pocket section 15 so as to be exposed, and is apertured, as at 24. An elongated tie seal 25, of any suitable material, such as plastic, may be inserted through aperture 24 and looped through an aperture 27 in an upstanding tab 26 on the zipper slider 11, when tab 26 extends through an elongated slot 28 in slider finger grip 12 and the latter is pivoted to the closed collapsed position of FIGS. 1 and 2.

In the above described closed position of the zipper slider, it is desirable that the slide fastener be retained in locked position relative to the slider tooth strip 9 when so attached to the address card. This may be effected by a downwardly depending pin 30, on the underside 29 of slider finger grip 12 adjacent the pivot thereof, which, inthe closed position of the grip, projects through aperture 31 in slider 11 and between the teeth of slider strip 9 and serves to prevent the slider and bag mouth from being opened, unless the tie seal 25 is broken.

While the preferred embodiment of transit bag with address card pocket and address card has been shown and described, it is to be understood that various changes and improvements may be made therein without departing from the scope and spirit of the appended claims.

What I claim:

1. A bag for carrying mail or the like comprising two overlying panels of similar size and shape secured along their two peripheral sides and bottom edges to form a main pocket therebetween, said top edges being unsecured to provide a mouth, a slide fastener connected to said panels along said top edges for opening and closing said main pocket mouth, a card pocket including spaced upper and lower sections covered with transparent material and an exposed open mid portion therebetween, an address card removably inserted beneath said pocket sections and having spaced upper and lower address portions thereon and a blank mid portion therebetween whereby said addresses are covered by said transparent material and said exposed mid portion is accessible for receiving and cancelling postage.

2. A bag according to claim 1, wherein said upper and lower sections are covered with transparent patches and said card is slidably disposed beneath said pocket sections.

3. A bag according to claim 2, wherein said pocket sections are generally rectangular in shape with edge bindings extending therearound, the side edge bindings of each section and the bottom edge binding of said lower section being affixed to one of said panels, and the remaining top and bottom edge bindings being unsecured to said panel whereby said card is slidable beneath said sections so that addressed upper and lower portions are viewable through said transparent patches and the mid portion thereof is exposed and accessible for postage.

4. A bag according to claim 3, wherein said card is apertured at its upper end and is connectable thereat to said slide fastener.

5. A bag according to claim 4, wherein said slide fastener includes a slider and finger grip pivoted thereto, an upstanding apertured tab on said slider, and a slot in said finger grip for receiving said tab therein.

6. A bag according to claim 5, wherein tie seal means is insertable within said card aperture and connectable to said tab aperture for retaining said address card in said card pocket.

* * * * *